US005662327A

United States Patent [19]

Levinrad

[11] Patent Number: 5,662,327

[45] Date of Patent: Sep. 2, 1997

[54] SUPERMARKET BOARD GAME

[76] Inventor: Maxim D. Levinrad, 5643 Cedros Ave., Van Nuys, Calif. 91411

[21] Appl. No.: 725,833

[22] Filed: Oct. 7, 1996

[51] Int. Cl.[6] ..... A63F 3/00

[52] U.S. Cl. ..... 273/242; 273/243

[58] Field of Search ..... 273/236, 242, 273/243, 248, 249, 254

[56] References Cited

U.S. PATENT DOCUMENTS

| | | | |
|---|---|---|---|
| 1,092,642 | 4/1914 | Gibson | 273/243 |
| 1,125,867 | 1/1915 | Mohr | 273/243 |
| 3,567,226 | 3/1971 | Matthews | 273/248 |
| 3,759,521 | 9/1973 | Breslow et al. | 273/243 |
| 3,945,643 | 3/1976 | Breslow | 273/243 |
| 4,784,394 | 11/1988 | Sumin | 273/254 X |
| 5,190,292 | 3/1993 | Perry | 273/243 X |
| 5,584,484 | 12/1996 | Kenvyn | 273/243 |

FOREIGN PATENT DOCUMENTS

| | | | |
|---|---|---|---|
| 2277692 | 11/1994 | United Kingdom | 273/243 |

*Primary Examiner*—William E. Stoll
*Attorney, Agent, or Firm*—Daniel R. Kimbell

[57] ABSTRACT

A board game for play by one to six players. The board game has several container baskets, and a board with a number of connected paths. Each path has discrete places upon which a basket can be moved. Some of the paths allow for uni-directional travel and some paths allow for bi-directional travel. Non-passage areas are adjacent to the connected path. The board has an entrance and an exit for players' container baskets to enter, and to exit, respectively. A number of tokens are placed on discrete areas of the non-passage areas, directly adjacent the discrete places of the paths. The tokens bear indicia of value, and are claimed by a player's basket when it lands directly adjacent a token on non-passage area.

20 Claims, 2 Drawing Sheets

FIG. 1
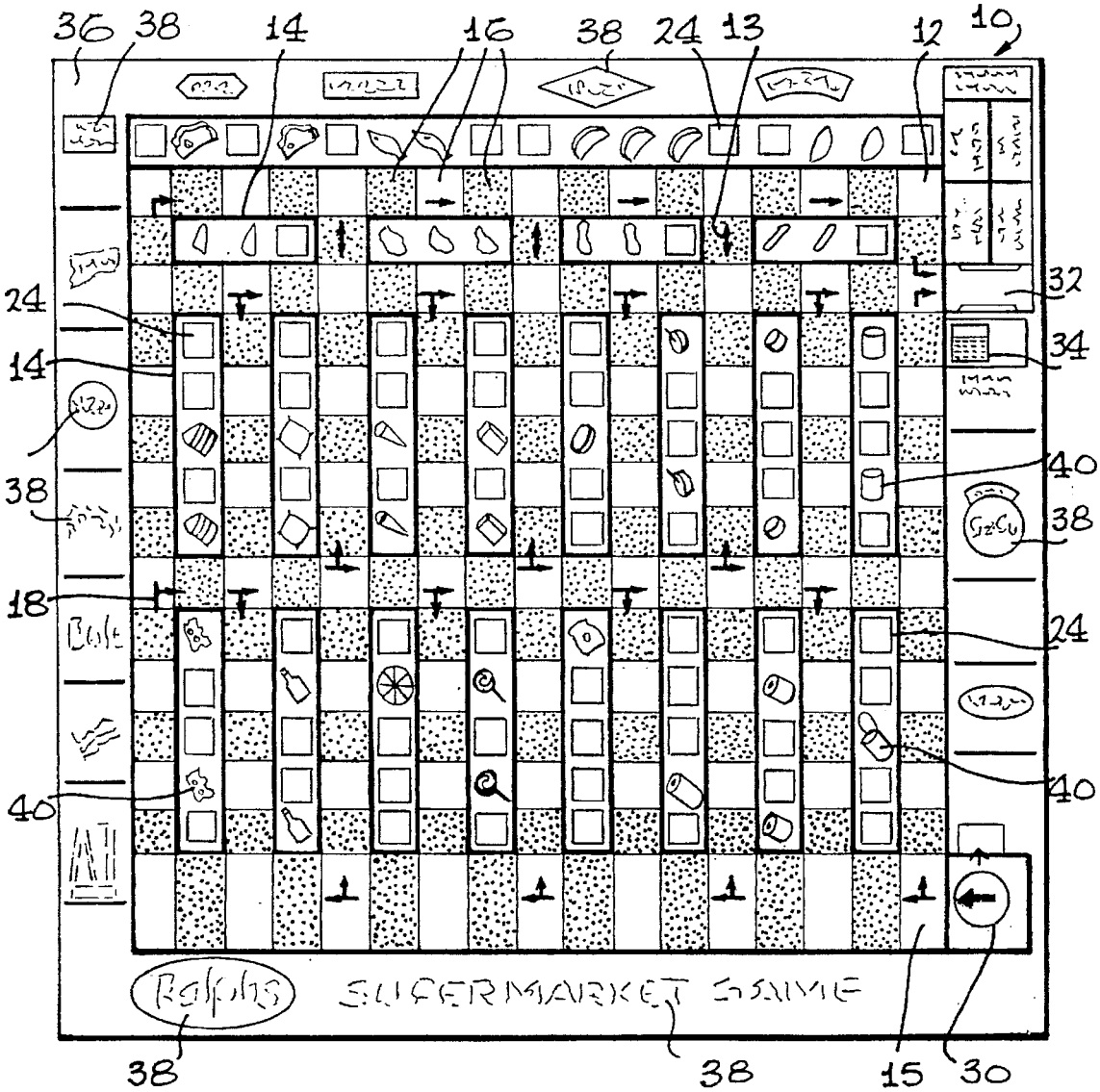
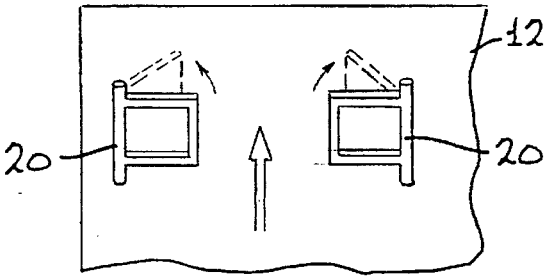
FIG. 2

SUPERMARKET BOARD GAME

BACKGROUND OF THE INVENTION

The invention relates to the field of games, and more particularly to board games.

BRIEF DESCRIPTION OF THE INVENTION

The invention is a board game for play by a plurality of players, comprising:

a plurality of container means;

a board portion having a plurality of paths, each path having discrete places upon which said container means can be moved, some of said paths allowing for uni-directional travel of said container means and some paths allowing for bi-directional travel of said container means, a plurality of non-passage areas adjacent said connected path, said connected paths having an entrance for players' container means to enter, and an exit, for players' container means to exit;

a plurality of tokens placed on discrete areas on said non-passage areas, directly adjacent said discrete places of said paths, said tokens bearing indicia of value, and being claimed by a player's container means when it lands directly adjacent a token on non-passage area.

The invention is a board game for play by a solitary player, comprising:

a container means;

a board portion having a plurality of paths, each path having discrete places upon which said container means can be moved, some of said paths allowing for uni-directional travel of said container means and some paths allowing for bi-directional travel of said container means, a plurality of non-passage areas adjacent said connected path, said connected paths having an entrance for player's container means to enter, and an exit, for player's container means to exit;

a plurality of tokens placed on discrete areas on said non-passage areas, directly adjacent said discrete places of said paths, said tokens bearing indicia of value, and being claimed by a player's container means when it lands directly adjacent a token on non-passage area.

BRIEF DESCRIPTION OF THE DRAWINGS

FIG. 1 is a top plan view showing a preferred embodiment of the game board of the invention.

FIG. 2 is a perspective view of an optional direction limiting gate.

DETAILED DESCRIPTION OF INVENTION

Figure 3:
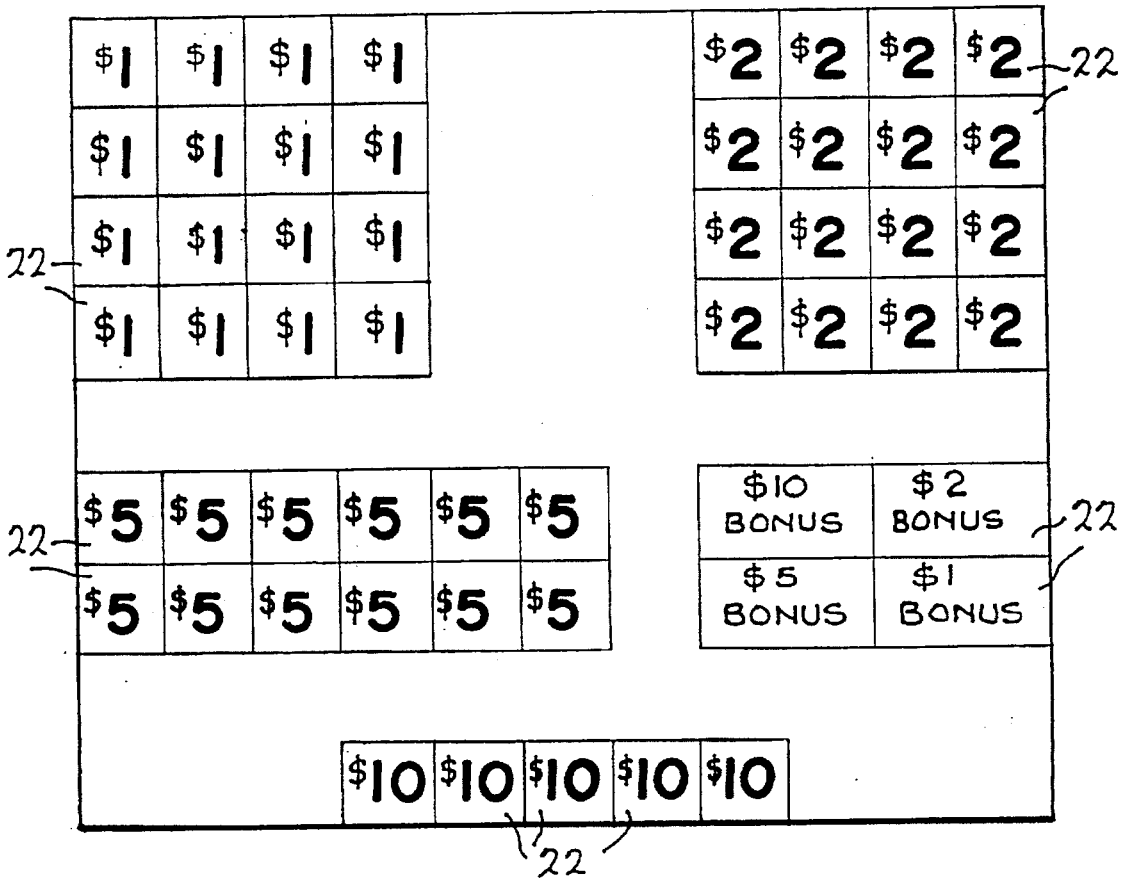
FIG. 3 is a top plan view of a sheet of tokens.

Referring to FIG. 1, the game board 10 of the invention is shown. It can comprise a cardboard board which can be foldable into half, can be formed of molded plastic (e.g. vacuum formed), or can be of some other form. A plurality of joined paths 12 and a plurality of non-passage areas 14 are located on the game board 10. Each of the paths 12 are divided into discrete places 16 upon which a player can land. Some of the paths 12 have indicia which allow for uni-directional travel, and some paths 13 allow for bi-directional travel. These directions of travel on the paths 12 and 13 can be so indicated by direction arrows 18, or more physically by gates 20 which will allow travel in a single direction. (See FIG. 2.) Each of the non-passage areas 14 is adjacent to at least one of the paths 12 and 13.

Referring to FIG. 3, tokens 22 bearing indicia of different value, e.g. $1, $2, $5, $10, etc., and also different color are provided. FIG. 3 shows a sheet of tokens 22, (not yet separated) which can comprise paper, plastic or other materials. These tokens 22 are placed on predetermined areas 24 of the non-passage areas 14. These predetermined areas 24 are preferably the same colors as the tokens 22, and/or are sized to receive the tokens 22 to prevent players from placing tokens randomly on the non-passage areas 14, (e.g. a $5 token 22 on a $1 area.)

Figure 4:
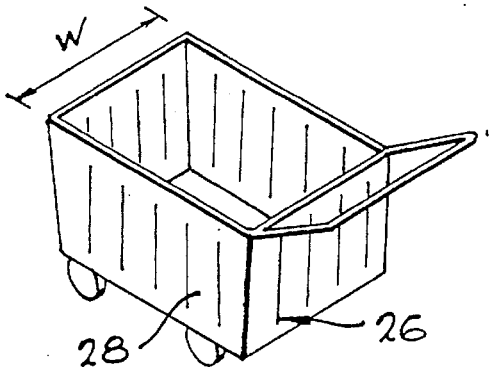
FIG. 4 is a perspective view of a container means in the form of a shopping basket used to move on the game board and carry tokens.

Referring to FIG. 4, a container means 26. This container means can comprise a basket having a width "W" has a carrying basket portion 28 which is adapted to carry tokens 22 a player collects. For added realism, the basket means 26 can be fashioned after a miniature shopping cart.

Figure 5:
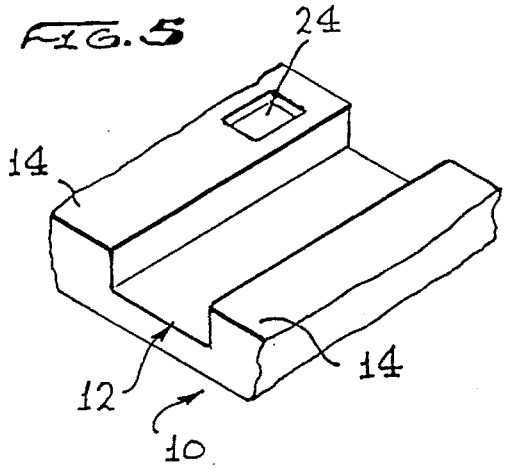
FIG. 5 is a cross-sectional detail of an alternate embodiment of the game board of the invention, wherein the game board has paths and non-passage areas of different horizontal levels formed therein to prevent players from moving their baskets out of the paths.

Referring to FIG. 5, if desired, the paths 12 and 13 can be of a different horizontal level than the non-passage areas 14 to prevent a player's basket means 26 from being moved out of a path 12 or 13, and into a non-passage areas 14. The difference in horizontal levels between the paths 12 and 13 and the non-passage areas 14 can be molded directly into the game board 10 (e.g. if the game board is molded plastic or paper), or can be formed from layered, molded, or laminated cardboard or paper and the like. The width of certain of the paths 12 and 13 can be sized so that only a single basket means 26 can pass therethrough at a single time, or, in the case of the path portion 15 near the entrance 30, if desired, can be wider so more than one basket 28 can occupy a discrete place 16.

As shown in FIG. 2, the game board's 10 entrance 30 and exit 32 can also have direction limiting gates 20, which have the appearance of turnstiles which allow for only entrance and exit of the basket means 26, respectively.

Referring to FIG. 1, the board portion can incorporate a calculator 34 for players to add up the valve of tokens 22 collected. As shown in FIG. 1, this calculator can represent the cash register at the check out counter, which is at the exit point of the game. The perimeter 36 of the board 10 can have printed logos 38 placed thereon, and printed indicia of merchandise 40 can appear on areas of the non-passage areas 14 not occupiable with tokens 22. For added realism, the paths 12, 13 and 15 can be made to appear as aisles and the non-passage areas 14 as shelves with merchandise in a retail store, such as a supermarket.

The game can be played by following the attached rules. The purpose of the direction arrows 18 and/or the direction limiting gates 20 is to force a player to carefully evaluate which paths 12, 13 and 15 he or she should follow with his or her basket 26 to allow the maximum value of tokens 22 to be collected. In addition to being played by two to six players, the game can be played by a solitary player by following slightly different rules. A solitary player can play and enjoy the game, for example, by finding most optimal route by which the maximum value of value of tokens 22 can be collected, and in this way play against him or herself, or even others.

The drawings and the foregoing description are not intended to represent the only form of the invention in regard to the details of this construction and manner of operation. In fact, it will be evident to one skilled in the art that modifications and variations may be made without departing from the spirit and scope of the invention. Although specific terms have been employed, they are intended in a generic and descriptive sense only and not for the purpose of limitation, the scope of the invention being delineated in the following claims.

What is claimed is:

1. A board game for play by a plurality of players, comprising:

a plurality of container means;

a board portion having a plurality of paths, each path having discrete places upon which said container means can be moved, some of said paths allowing for uni-directional travel of said container means and some paths allowing for bi-directional travel of said container means, a plurality of non-passage areas adjacent said connected path, said connected paths having an entrance for players' container means to enter, and an exit, for players' container means to exit;

a plurality of tokens placed on discrete areas on said non-passage areas, directly adjacent said discrete places of said paths, said tokens bearing indicia of value, and being claimed by a player's container means when it lands directly adjacent a token on non-passage area.

2. The board game for play by a plurality of players of claim 1, wherein some of said plurality of connected paths for passage of said container means have a width which will allow only a single container means to pass at any particular place on a path at the same time.

3. The board game for play by a plurality of players of claim 1, wherein said plurality of connected paths for passage of said container means have a level different from that of said non-passage areas to help prevent said container means from crossing said non-passage areas.

4. The board game for play by a plurality of players of claim 3, wherein said game board comprises molded plastic with the different levels of paths for passage and non-passage areas being molded therein.

5. The board game for play by a plurality of players of claim 3, wherein said game board comprises paper, with the different levels of paths for passage and non-passage areas being established by differences in paper height.

6. The board game for play by a plurality of players of claim 1, further comprising a calculator for players to add up the value of tokens collected.

7. The board game for play by a plurality of players of claim 1, wherein said entrance and exits to said game board comprise turnstile means which allow for only entrance and exit, respectively.

8. The board game for play by a plurality of players of claim 1, wherein said container means comprise wheeled shopping baskets with a container portion sized to receive a plurality of said tokens.

9. The board game for play by a plurality of players of claim 1, wherein said tokens have different colors depending on their different indicia of value, which are placed on like colored discrete places on said non-passage areas.

10. The board game for play by a plurality of players of claim 1, wherein said tokens engage with said discrete places on said non-passage areas.

11. The board game for play by a plurality of players of claim 1, wherein said paths signify aisles and said non-passage areas signify shelves of a retail store.

12. A board game for play by a solitary player, comprising:

a container means;

a board portion having a plurality of paths, each path having discrete places upon which said container means can be moved, some of said paths allowing for uni-directional travel of said container means and some paths allowing for bi-directional travel of said container means, a plurality of non-passage areas adjacent said connected path, said connected paths having an entrance for player's container means to enter, and an exit, for player's container means to exit;

a plurality of tokens placed on discrete areas on said non-passage areas, directly adjacent said discrete places of said paths, said tokens bearing indicia of value, and being claimed by a player's container means when it lands directly adjacent a token on non-passage area.

13. The board game for play by a solitary player of claim 12, wherein some of said plurality of connected paths for passage of said container means have a width which will allow only a single container means to pass at any particular place on a path at the same time.

14. The board game for play by a solitary player of claim 12, wherein said plurality of connected paths for passage of said container means have a level different from that of said non-passage areas to help prevent said container means from crossing said non-passage areas.

15. The board game for play by a solitary player of claim 12, wherein said game board comprises molded plastic with the different levels of paths for passage and non-passage areas being molded therein.

16. The board game for play by a solitary player of claim 12, wherein said game board comprises paper, with the different levels of paths for passage and non-passage areas being established by differences in paper height.

17. The board game for play by a solitary player of claim 12, further comprising a calculator for players to add up the valve of tokens collected.

18. The board game for play by a solitary player of claim 12, wherein said entrance and exits to said game board comprise turnstile means which allow for only entrance and exit, respectively.

19. The board game for play by a solitary player of claim 12, wherein said container means comprise wheeled shopping baskets with a container portion sized to receive a plurality of said tokens, and said tokens engage with said discrete places on said non-passage areas.

20. The board game for play by a solitary player of claim 12, wherein said tokens have different colors depending on their different indicia of value, which are placed on like colored discrete places on said non-passage areas.

* * * * *